US010301560B2

(12) United States Patent
Wang et al.

(10) Patent No.: US 10,301,560 B2
(45) Date of Patent: May 28, 2019

(54) PROCESS AND APPARATUS FOR HYDROCRACKING A HYDROCARBON STREAM IN TWO STAGES WITH AROMATIC SATURATION

(71) Applicant: UOP LLC, Des Plaines, IL (US)

(72) Inventors: Haiyan Wang, Hoffman Estates, IL (US); Richard K. Hoehn, Mount Prospect, IL (US); Xin X. Zhu, Long Grove, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 15/599,289

(22) Filed: May 18, 2017

(65) Prior Publication Data

US 2017/0362516 A1 Dec. 21, 2017

Related U.S. Application Data

(60) Provisional application No. 62/350,645, filed on Jun. 15, 2016.

(51) Int. Cl.
*C10G 65/12* (2006.01)
*C10G 45/44* (2006.01)

(52) U.S. Cl.
CPC ..... *C10G 65/12* (2013.01); *C10G 45/44* (2013.01); *C10G 2300/1092* (2013.01)

(58) Field of Classification Search
CPC ..... C10G 45/44; C10G 65/12
See application file for complete search history.

(56) References Cited

U.S. PATENT DOCUMENTS 3,100,006 A 8/1963 Sheets et al.
3,761,395 A * 9/1973 Child ..... C10G 47/20 208/89
4,363,718 A 12/1982 Klotz
5,705,052 A * 1/1998 Gupta ..... C10G 49/002 208/210
6,036,844 A * 3/2000 Gupta ..... C10G 65/00 208/143
6,444,116 B1 * 9/2002 Galiasso ..... C10G 49/22 208/311
6,835,301 B1 * 12/2004 Ellis ..... C10G 65/12 208/210
7,166,209 B2 * 1/2007 Dassori ..... C10G 45/02 208/210
7,790,020 B2 9/2010 Kokayeff et al.
8,343,334 B2 1/2013 Koseoglu et al.
8,936,714 B2 1/2015 Kokayeff et al.
8,968,552 B2 3/2015 Ramaseshan et al.
9,108,122 B2 8/2015 Kokayeff et al.
9,725,661 B2 * 8/2017 Greene ..... C10G 63/02
2015/0064076 A1 3/2015 Sadler et al.

FOREIGN PATENT DOCUMENTS

EP 1183320 A1 3/2002

OTHER PUBLICATIONS

Varga, "Quality improvement of heavy gas oil with hydroprocessing", Periodica Polytechnica: Chemical Engineering, 58(2), pp. 117-123, 2014.

* cited by examiner

*Primary Examiner* — Randy Boyer
(74) *Attorney, Agent, or Firm* — Paschall and Maas Law Office; James C. Paschall

(57) ABSTRACT

A process and apparatus for two stage hydrocracking saturates aromatics from the first stage hydrocracking unit to prevent production of HPNA's. The saturated HPNA's can be hydrocracked in the second stage to minimize or eliminate purged unconverted oil to approach or obtain maximum conversion. In an aspect, the second stage hydrocracking reactor and hydrotreating reactor may be located in the same vessel.

11 Claims, 2 Drawing Sheets

PROCESS AND APPARATUS FOR HYDROCRACKING A HYDROCARBON STREAM IN TWO STAGES WITH AROMATIC SATURATION

CROSS-REFERENCE TO RELATED APPLICATION

This application claims priority from Provisional Application No. 62/350,645 filed Jun. 15, 2016, the contents of which cited application are hereby incorporated by reference in its entirety.

FIELD

The field is the hydrocracking of hydrocarbon streams, particularly two-stage hydrocracking and saturation of hydrocarbon streams.

BACKGROUND

Hydroprocessing can include processes which convert hydrocarbons in the presence of hydroprocessing catalyst and hydrogen to more valuable products. Hydrocracking is a hydroprocessing process in which hydrocarbons crack in the presence of hydrogen and hydrocracking catalyst to lower molecular weight hydrocarbons. Depending on the desired output, a hydrocracking unit may contain one or more fixed beds of the same or different catalyst. Hydrotreating is a process in which hydrogen is contacted with a hydrocarbon stream in the presence of hydrotreating catalysts which are primarily active for the removal of heteroatoms, such as sulfur, nitrogen and metals from the hydrocarbon feedstock. In hydrotreating, hydrocarbons with double and triple bonds may be saturated. Aromatics may also be saturated. Some hydrotreating processes are specifically designed to saturate aromatics.

Two-stage hydrocracking processes involve fractionation of a hydrocracked stream from a first stage hydrocracking reactor followed by hydrocracking of an unconverted oil (UCO) stream in a second stage hydrocracking reactor. However, the best two-stage hydrocracking process cannot achieve full conversion to materials boiling below the diesel cut point. Typically, a bottoms stream from the fractionation column in two-stage hydrocracking comprises a recycle oil (RO) stream and an UCO stream. The RO is recycled to the second stage hydrocracking reactor while the UCO is purged from the process to remove unconvertible heavy polynuclear aromatics (HPNA's) from the process. HPNA's are fused aromatic rings comprising more than eight rings. HPNA's in RO and UCO can cause significant adverse impact on hydrocracking operations such as fouling of the exchangers and coking on the catalyst. Several processes are available to manage HPNA rejection, such as steam stripping and adsorption.

Better processes and apparatuses are needed to remove HPNA's from RO streams and to improve hydrocracking conversion.

BRIEF SUMMARY

A process and apparatus for two stage hydrocracking involves the saturation of aromatics from the first stage hydrocracking unit to prevent accumulation of HPNA's in the second stage hydrocracking unit. The saturated HPNA's can be hydrocracked in the second stage to minimize or eliminate purged unconverted oil to approach or obtain maximum conversion. In an aspect, the second stage hydrocracking reactor and the second stage hydrotreating reactor may be located in the same vessel.

DEFINITIONS

Figure 1:
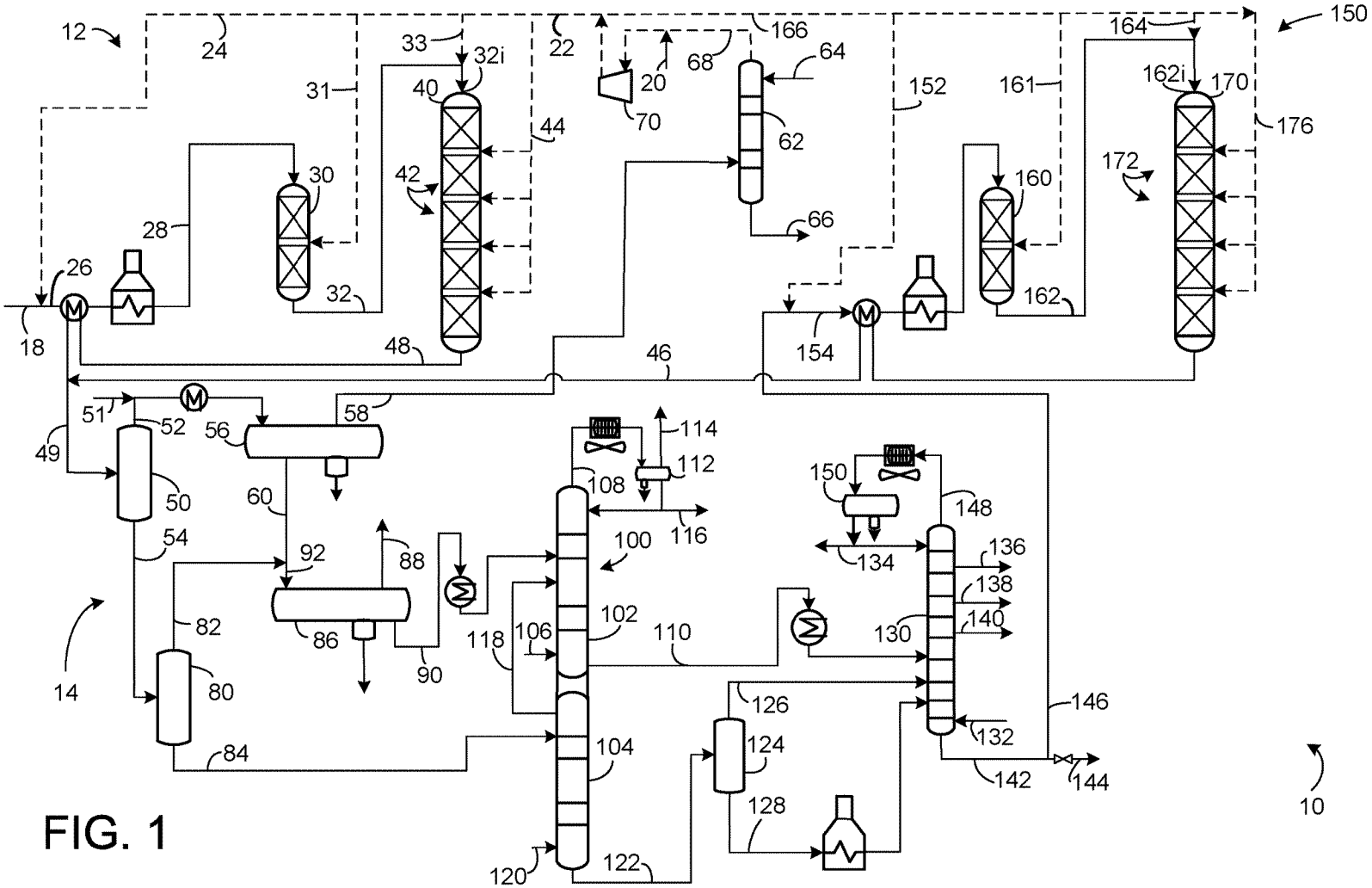
FIG. 1 is a schematic drawing of a two-stage hydrocracking unit.

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" means that flow from the upstream component enters the downstream component without undergoing a compositional change due to physical fractionation or chemical conversion.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Absorber and scrubbing columns do not include a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The overhead pressure is the pressure of the overhead vapor at the vapor outlet of the column. The bottom temperature is the liquid bottom outlet temperature. Overhead lines and bottoms lines refer to the net lines from the column downstream of any reflux or reboil to the column unless otherwise indicated. Stripping columns omit a reboiler at a bottom of the column and instead provide heating requirements and separation impetus from a fluidized inert vaporous media such as steam.

As used herein, the term "True Boiling Point" (TBP) means a test method for determining the boiling point of a material which corresponds to ASTM D-2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "initial boiling point" (IBP) means the temperature at which the sample begins to boil using ASTM D-86.

As used herein, the term "T5" or "T95" means the temperature at which 5 volume percent or 95 volume percent, as the case may be, respectively, of the sample boils using ASTM D-86.

As used herein, the term "diesel boiling range" means hydrocarbons boiling in the range of between about 132° C.

(270° F.) and the diesel cut point between about 343° C. (650° F.) and about 399° C. (750° F.) using the TBP distillation method.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator which latter may be operated at higher pressure.

DETAILED DESCRIPTION

We have found that HPNA formation in hydrocracking units is due to condensation of aromatic precursors present in the feed as a result of the hydrocracking process. UCO is typically purged as a byproduct to limit the concentration of HPNA's in the RO. By completely saturating aromatics, HPNA formation can be prevented and the UCO purge can be reduced or eliminated, thereby improving yields. To achieve full saturation of aromatics, the feed must be hydrotreated over a catalyst with noble metals. However, activity of noble metal catalyst typically cannot survive under high concentrations of sulfur and nitrogen. Thus, segregation of noble metal catalyst from an environment of high sulfur and nitrogen concentration is a prerequisite for complete aromatics saturation.

The subject apparatus and process eliminates UCO production and HPNA management by integrating catalytic aromatics saturation with hydrocracking to enhance diesel yield selectivity and achieve full conversion.

The apparatus and process 10 for hydrocracking a hydrocarbon stream comprise a first stage hydrocracking unit 12, a fractionation section 14 and a second stage hydrocracking unit 150. A hydrocarbonaceous stream in hydrocarbon line 18 and a first stage hydrogen stream in a first stage hydrogen line 22 are fed to the first stage hydrocracking unit 12.

In one aspect, the process and apparatus described herein are particularly useful for hydrocracking a hydrocarbon feed stream comprising a hydrocarbonaceous feedstock. Illustrative hydrocarbonaceous feed stocks include hydrocarbon streams having initial boiling points (IBP) above about 288° C. (550° F.), such as atmospheric gas oils, vacuum gas oil (VGO) having T5 and T95 between about 315° C. (600° F.) and about 600° C. (1100° F.), deasphalted oil, coker distillates, straight run distillates, pyrolysis-derived oils, high boiling synthetic oils, cycle oils, clarified slurry oils, deasphalted oil, shale oil, hydrocracked feeds, catalytic cracker distillates, atmospheric residue having an IBP at or above about 343° C. (650° F.) and vacuum residue having an IBP above about 510° C. (950° F.).

A first hydrotreating hydrogen stream in a first hydrotreating hydrogen line 24 may split off from the first stage hydrogen line 22. The first hydrotreating hydrogen stream may join the hydrocarbonaceous stream in feed line 18 to provide a first hydrocarbon feed stream in a first hydrocarbon feed line 26. The first hydrocarbon feed stream in the first hydrocarbon feed line 26 may be heated by heat exchange with a first hydrocracked stream in line 48 and in a fired heater. The heated first hydrocarbon feed stream in line 28 may be fed to a first hydrotreating reactor 30.

Hydrotreating is a process wherein hydrogen is contacted with hydrocarbon in the presence of hydrotreating catalysts which are primarily active for the removal of heteroatoms, such as sulfur, nitrogen and metals from the hydrocarbon feedstock. In hydrotreating, hydrocarbons with double and triple bonds may be saturated. Aromatics may also be saturated. Some hydrotreating processes are specifically designed to saturate aromatics.

The first hydrotreating reactor 30 may comprise a guard bed of hydrotreating catalyst followed by one or more beds of higher quality hydrotreating catalyst. The guard bed filters particulates and picks up contaminants in the hydrocarbon feed stream such as metals like nickel, vanadium, silicon and arsenic which deactivate the catalyst. The guard bed may comprise material similar to the hydrotreating catalyst. Supplemental hydrogen in a first hydrotreating supplemental hydrogen line 31 may be added at an interstage location between catalyst beds in the first hydrotreating reactor 30.

Suitable first hydrotreating catalysts for use in the first hydrotreating reactor are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts. In the high sulfur and nitrogen environment of the first hydrotreating reactor 30, noble metal catalysts would be discouraged. More than one type of first hydrotreating catalyst may be used in the first hydrotreating reactor 30. The Group VIII metal is typically present in an amount ranging from about 2 to about 20 wt %, preferably from about 4 to about 12 wt %. The Group VI metal will typically be present in an amount ranging from about 1 to about 25 wt %, preferably from about 2 to about 25 wt %.

Preferred reaction conditions in the hydrotreating reactor 30 include a temperature from about 290° C. (550° F.) to about 455° C. (850° F.), suitably 316° C. (600° F.) to about 427° C. (800° F.) and preferably 343° C. (650° F.) to about 399° C. (750° F.), a pressure from about 2.1 MPa (gauge) (300 psig), preferably 4.1 MPa (gauge) (600 psig) to about 20.6 MPa (gauge) (3000 psig), suitably 13.8 MPa (gauge) (2000 psig), preferably 12.4 MPa (gauge) (1800 psig), a liquid hourly space velocity of the fresh hydrocarbonaceous feedstock from about 0.1 $hr^{-1}$, suitably 0.5 $hr^{-1}$, to about 10 $hr^{-1}$, preferably from about 1.5 to about 8.5 $hr^{-1}$, and a hydrogen rate of about 168 $Nm^3/m^3$ (1,000 scf/bbl), to about 1,011 $Nm^3/m^3$ oil (6,000 scf/bbl), preferably about 168 $Nm^3/m^3$ oil (1,000 scf/bbl) to about 674 $Nm^3/m^3$ oil (4,000 scf/bbl), with a hydrotreating catalyst or a combination of hydrotreating catalysts.

The first hydrocarbon feed stream in the first hydrocarbon feed line 28 is hydrotreated over the first hydrotreating catalyst in the first hydrotreating reactor 30 to provide a first hydrotreated hydrocarbon feed stream that exits the first hydrotreating reactor 30 in a first hydrotreating effluent line 32 which can be taken as a first hydrocracking feed stream. The hydrogen gas laden with ammonia and hydrogen sulfide may be removed from the first hydrocracking feed stream in a separator, but the first hydrocracking feed stream is typically fed directly to the hydrocracking reactor 40 without separation. The first hydrocracking feed stream may be mixed with a first hydrocracking hydrogen stream in a first hydrocracking hydrogen line 33 from the first stage hydrogen line 22 and is fed through a first inlet **32*i* to the first hydrocracking reactor 40** to be hydrocracked.

Hydrocracking is a process in which hydrocarbons crack in the presence of hydrogen to lower molecular weight hydrocarbons. The first hydrocracking reactor 40 may be a fixed bed reactor that comprises one or more vessels, single or multiple catalyst beds 42 in each vessel, and various combinations of hydrotreating catalyst, hydroisomerization catalyst and/or hydrocracking catalyst in one or more vessels. It is contemplated that the first hydrocracking reactor 40 be operated in a continuous liquid phase in which the volume of the liquid hydrocarbon feed is greater than the volume of the hydrogen gas. The first hydrocracking reactor 40 may also be operated in a conventional continuous gas phase, a moving bed or a fluidized bed hydroprocessing reactor.

The first hydrocracking reactor 40 comprises a plurality of first hydrocracking catalyst beds 42. If the hydrocracking unit 12 does not include a first hydrotreating reactor 30, the first catalyst bed in the hydrocracking reactor 40 may include a first hydrotreating catalyst for the purpose of saturating, demetallizing, desulfurizing or denitrogenating the first hydrocarbon feed stream before it is hydrocracked with the first hydrocracking catalyst in subsequent vessels or catalyst beds 42 in the first hydrocracking reactor 40. Otherwise, the first or an upstream bed in the first hydrocracking reactor 40 may comprise a first hydrocracking catalyst bed 42.

The hydrotreated first hydrocracking feed stream is hydrocracked over a first hydrocracking catalyst in the first hydrocracking catalyst beds 42 in the presence of a first hydrocracking hydrogen stream from a first hydrocracking hydrogen line 33 to provide a first hydrocracked stream. Subsequent catalyst beds 42 in the hydrocracking reactor may comprise hydrocracking catalyst over which additional hydrocracking occurs to the hydrocracked stream. Hydrogen manifold 44 may deliver supplemental hydrogen streams to one, some or each of the catalyst beds 42. In an aspect, the supplemental hydrogen is added to each of the catalyst beds 42 at an interstage location between adjacent beds, so supplemental hydrogen is mixed with hydroprocessed effluent exiting from the upstream catalyst bed 42 before entering the downstream catalyst bed 42.

The first hydrocracking reactor may provide a total conversion of at least about 20 vol % and typically greater than about 60 vol % of the first hydrocracking feed stream in the first hydrotreating effluent line 32 to products boiling below the diesel cut point. The first hydrocracking reactor 40 may operate at partial conversion of more than about 30 vol % or full conversion of at least about 90 vol % of the feed based on total conversion. The first hydrocracking reactor 40 may be operated at mild hydrocracking conditions which will provide about 20 to about 60 vol %, preferably about 20 to about 50 vol %, total conversion of the hydrocarbon feed stream to product boiling below the diesel cut point.

The first hydrocracking catalyst may utilize amorphous silica-alumina bases or low-level zeolite bases combined with one or more Group VIII or Group VIB metal hydrogenating components if mild hydrocracking is desired to produce a balance of middle distillate and gasoline. In another aspect, when middle distillate is significantly preferred in the converted product over gasoline production, partial or full hydrocracking may be performed in the first hydrocracking reactor 40 with a catalyst which comprises, in general, any crystalline zeolite cracking base upon which is deposited a Group VIII metal hydrogenating component. Additional hydrogenating components may be selected from Group VIB for incorporation with the zeolite base.

The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and about 14 Angstroms ($10^{-10}$ meters). It is preferred to employ zeolites having a relatively high silica/alumina mole ratio between about 3 and about 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8 and 12 Angstroms ($10^{-10}$ meters), wherein the silica/alumina mole ratio is about 4 to 6. One example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,100,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. In one aspect, the preferred cracking bases are those which are at least about 10 wt %, and preferably at least about 20 wt %, metal-cation-deficient, based on the initial ion-exchange capacity. In another aspect, a desirable and stable class of zeolites is one wherein at least about 20 wt % of the ion exchange capacity is satisfied by hydrogen ions.

The active metals employed in the preferred first hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 wt % and about 30 wt % may be used. In the case of the noble metals, it is normally preferred to use about 0.05 to about 2 wt % noble metal.

The method for incorporating the hydrogenation metal is to contact the base material with an aqueous solution of a suitable compound of the desired metal wherein the metal is present in a cationic form. Following addition of the selected hydrogenation metal or metals, the resulting catalyst powder is then filtered, dried, pelleted with added lubricants, binders or the like if desired, and calcined in air at temperatures of, e.g., about 371° C. (700° F.) to about 648° C. (1200° F.) in order to activate the catalyst and decompose ammonium ions. Alternatively, the base component may first be pelleted, followed by the addition of the hydrogenation component and activation by calcining.

The foregoing catalysts may be employed in undiluted form, or the powdered catalyst may be mixed and copelleted with other relatively less active catalysts, diluents or binders such as alumina, silica gel, silica-alumina cogels, activated clays and the like in proportions ranging between about 5 and about 90 wt %. These diluents may be employed as such or they may contain a minor proportion of an added hydrogenating metal such as a Group VIB and/or Group VIII metal. Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718.

By one approach, the hydrocracking conditions may include a temperature from about 290° C. (550° F.) to about 468° C. (875° F.), preferably 343° C. (650° F.) to about 445° C. (833° F.), a pressure from about 4.8 MPa (gauge) (700 psig) to about 20.7 MPa (gauge) (3000 psig), a liquid hourly space velocity (LHSV) from about 0.4 to less than about 2.5 $hr^{-1}$ and a hydrogen rate of about 421 $Nm^3/m^3$ (2,500 scf/bbl) to about 2,527 $Nm^3/m^3$ oil (15,000 scf/bbl). If mild hydrocracking is desired, conditions may include a temperature from about 315° C. (600° F.) to about 441° C. (825° F.), a pressure from about 5.5 MPa (gauge) (800 psig) to about 13.8 MPa (gauge) (2000 psig) or more typically about 6.9 MPa (gauge) (1000 psig) to about 11.0 MPa (gauge) (1600 psig), a liquid hourly space velocity (LHSV) from about 0.5 to about 2 $hr^{-1}$ and preferably about 0.7 to about 1.5 $hr^{-1}$ and a hydrogen rate of about 421 $Nm^3/m^3$ oil (2,500 scf/bbl) to about 1,685 $Nm^3/m^3$ oil (10,000 scf/bbl).

The first hydrocracked stream may exit the first hydrocracking reactor 40 in line 48 and be separated in the fractionation section 14 in downstream communication with the first hydrocracking reactor 40. The fractionation section 14 comprises one or more separators and fractionation columns in downstream communication with the hydrocracking reactor 40.

The first hydrocracked stream in the first hydrocracked line 48 may in an aspect be heat exchanged with the hydrocarbon feed stream in line 26 to be cooled and be mixed with a second hydrocracked effluent in a second hydrocracked effluent line 46. The combined hydrocracked effluent line 49 may deliver a combined stream to a hot separator 50.

The hot separator separates the first hydrocracked stream and the second hydrocracked stream to provide a hydrocarbonaceous, hot gaseous stream in a hot overhead line 52 and a hydrocarbonaceous, hot liquid stream in a hot bottoms line 54. The hot separator 50 may be in downstream communication with the hydrocracking reactor 40. The hot separator 50 operates at about 177° C. (350° F.) to about 371° C. (700° F.) and preferably operates at about 232° C. (450° F.) to about 315° C. (600° F.). The hot separator 50 may be operated at a slightly lower pressure than the first hydrocracking reactor 40 accounting for pressure drop through intervening equipment. The hot separator 50 may be operated at pressures between about 3.4 MPa (gauge) (493 psig) and about 20.4 MPa (gauge) (2959 psig). The hydrocarbonaceous, hot gaseous separated stream in the hot overhead line 52 may have a temperature of the operating temperature of the hot separator 50.

The hot gaseous stream in the hot overhead line 52 may be cooled before entering a cold separator 56. As a consequence of the reactions taking place in the first hydrocracking reactor 40 wherein nitrogen, chlorine and sulfur are removed from the feed, ammonia and hydrogen sulfide are formed. At a characteristic sublimation temperature, ammonia and hydrogen sulfide will combine to form ammonium bisulfide and ammonia, and chlorine will combine to form ammonium chloride. Each compound has a characteristic sublimation temperature that may allow the compound to coat equipment, particularly heat exchange equipment, impairing its performance. To prevent such deposition of ammonium bisulfide or ammonium chloride salts in the hot overhead line 52 transporting the hot gaseous stream, a suitable amount of wash water may be introduced into the hot overhead line 52 upstream of a cooler by water line 51 at a point in the hot overhead line where the temperature is above the characteristic sublimation temperature of either compound.

The hot gaseous stream may be separated in the cold separator 56 to provide a cold gaseous stream comprising a hydrogen-rich gas stream in a cold overhead line 58 and a cold liquid stream in a cold bottoms line 60. The cold separator 56 serves to separate hydrogen rich gas from hydrocarbon liquid in the first hydrocracked stream and the second hydrocracked stream for recycle to the first stage hydrocracking unit 12 and the second stage hydrocracking unit 150 in the cold overhead line 58. The cold separator 56, therefore, is in downstream communication with the hot overhead line 52 of the hot separator 50 and the hydrocracking reactor 40. The cold separator 56 may be operated at about 100° F. (38° C.) to about 150° F. (66° C.), suitably about 115° F. (46° C.) to about 145° F. (63° C.), and just below the pressure of the first hydrocracking reactor 40 and the hot separator 50 accounting for pressure drop through intervening equipment to keep hydrogen and light gases in the overhead and normally liquid hydrocarbons in the bottoms. The cold separator 56 may be operated at pressures between about 3 MPa (gauge) (435 psig) and about 20 MPa (gauge) (2,901 psig). The cold separator 56 may also have a boot for collecting an aqueous phase. The cold liquid stream in the cold bottoms line 60 may have a temperature of the operating temperature of the cold separator 56.

The cold gaseous stream in the cold overhead line 58 is rich in hydrogen. Thus, hydrogen can be recovered from the cold gaseous stream. The cold gaseous stream in the cold overhead line 58 may be passed through a trayed or packed recycle scrubbing column 62 where it is scrubbed by means of a scrubbing extraction liquid such as an aqueous solution fed by line 64 to remove acid gases including hydrogen sulfide and carbon dioxide by extracting them into the aqueous solution. Preferred aqueous solutions include lean amines such as alkanolamines DEA, MEA, and MDEA. Other amines can be used in place of or in addition to the preferred amines. The lean amine contacts the cold gaseous stream and absorbs acid gas contaminants such as hydrogen sulfide and carbon dioxide. The resultant "sweetened" cold gaseous stream is taken out from an overhead outlet of the recycle scrubber column 62 in a recycle scrubber overhead line 68, and a rich amine is taken out from the bottoms at a bottom outlet of the recycle scrubber column in a recycle scrubber bottoms line 66. The spent scrubbing liquid from the bottoms may be regenerated and recycled back to the recycle scrubbing column 62 in line 64. The scrubbed hydrogen-rich stream emerges from the scrubber via the recycle scrubber overhead line 68 and may be compressed in a recycle compressor 70. The scrubbed hydrogen-rich stream in the scrubber overhead line 68 may be supplemented with make-up hydrogen stream in the make-up line 20 upstream or downstream of the compressor 70. The compressed hydrogen stream supplies hydrogen to the first stage hydrogen stream in the first stage hydrogen line 22 and a second stage hydrogen stream in a second stage hydrogen line 166. The recycle scrubbing column 62 may be operated with a gas inlet temperature between about 38° C. (100° F.) and about 66° C. (150° F.) and an overhead pressure of about 3 MPa (gauge) (435 psig) to about 20 MPa (gauge) (2900 psig).

The hydrocarbonaceous hot liquid stream in the hot bottoms line 54 may be directly stripped. In an aspect, the hot liquid stream in the hot bottoms line 54 may be let down in pressure and flashed in a hot flash drum 80 to provide a flash hot gaseous stream of light ends in a flash hot overhead line 82 and a flash hot liquid stream in a flash hot bottoms line 84. The hot flash drum 80 may be in direct, downstream communication with the hot bottoms line 54 and in downstream communication with the first hydrocracking reactor 40. In an aspect, light gases such as hydrogen sulfide may be stripped from the flash hot liquid stream in the flash hot bottoms line 84. Accordingly, a stripping column 100 may be in downstream communication with the hot flash drum 80 and the hot flash bottoms line 84.

The hot flash drum 80 may be operated at the same temperature as the hot separator 50 but at a lower pressure of between about 1.4 MPa (gauge) (200 psig) and about 6.9 MPa (gauge) (1000 psig), suitably no more than about 3.8 MPa (gauge) (550 psig). The flash hot liquid stream in the flash hot bottoms line 84 may be further fractionated in the fractionation section 14. The flash hot liquid stream in the flash hot bottoms line 84 may have a temperature of the operating temperature of the hot flash drum 80.

In an aspect, the cold liquid stream in the cold bottoms line 60 may be directly stripped. In a further aspect, the cold liquid stream may be let down in pressure and flashed in a cold flash drum 86 to separate the cold liquid stream in the cold bottoms line 60. The cold flash drum 86 may be in direct downstream communication with the cold bottoms line 60 of the cold separator 56 and in downstream communication with the hydrocracking reactor 40.

In a further aspect, the flash hot gaseous stream in the flash hot overhead line 82 may be fractionated in the fractionation section 14. In a further aspect, the flash hot gaseous stream may be cooled and also separated in the cold flash drum 86. The cold flash drum 86 may separate the cold liquid stream in line 60 and/or the flash hot gaseous stream in the flash hot overhead line 82 to provide a flash cold gaseous stream in a flash cold overhead line 88 and a flash cold liquid stream in a cold flash bottoms line 90. In an aspect, light gases such as hydrogen sulfide may be stripped from the flash cold liquid stream in the flash cold bottoms line 90. Accordingly, a stripping column 100 may be in downstream communication with the cold flash drum 86 and the cold flash bottoms line 90.

The cold flash drum 86 may be in downstream communication with the cold bottoms line 60 of the cold separator 56, the hot flash overhead line 82 of the hot flash drum 80 and the hydrocracking reactor 40. The flash cold liquid stream in the cold bottoms line 60 and the flash hot gaseous stream in the hot flash overhead line 82 may enter into the cold flash drum 86 either together or separately. In an aspect, the hot flash overhead line 82 joins the cold bottoms line 60 and feeds the flash hot gaseous stream and the cold liquid stream together to the cold flash drum 86 in a cold flash feed line 92. The cold flash drum 86 may be operated at the same temperature as the cold separator 56 but typically at a lower pressure of between about 1.4 MPa (gauge) (200 psig) and about 6.9 MPa (gauge) (1000 psig) and preferably between about 3.0 MPa (gauge) (435 psig) and about 3.8 MPa (gauge) (550 psig). A flashed aqueous stream may be removed from a boot in the cold flash drum 86. The flash cold liquid stream in the flash cold bottoms line 90 may have the same temperature as the operating temperature of the cold flash drum 86. The flash cold gaseous stream in the flash cold overhead line 88 contains substantial hydrogen that may be recovered.

The fractionation section 14 may further include the stripping column 100 and a fractionation column 130. The stripping column 100 may be in downstream communication with a bottoms line in the fractionation section 14 for stripping volatiles from a first hydrocracked stream and a second hydrocracked stream. For example, the stripping column 100 may be in downstream communication with the hot bottoms line 54, the flash hot bottoms line 84, the cold bottoms line 60 and/or the cold flash bottoms line 90. In an aspect, the stripping column 100 may be a vessel that contains a cold stripping column 102 and a hot stripping column 104 with a wall that isolates each of the stripping columns 102, 104 from the other. The cold stripping column 102 may be in downstream communication with the first hydrocracking reactor 40, a second hydrocracking reactor 170, the cold bottoms line 60 and, in an aspect, the flash cold bottoms line 90 for stripping the cold liquid stream. The hot stripping column 104 may be in downstream communication with the first hydrocracking reactor 40, the second hydrocracking reactor 170, and the hot bottoms line 54 and, in an aspect, the flash hot bottoms line 84 for stripping a hot liquid stream which is hotter than the cold liquid stream. The hot liquid stream may be hotter than the cold liquid stream, by at least 25° C. and preferably at least 50° C.

The flash cold liquid stream comprising the first hydrocracked stream and the second hydrocracked stream in the flash cold bottoms line 90 may be heated and fed to the cold stripping column 102 at an inlet which may be in a top half of the column. The flash cold liquid stream which comprises the first hydrocracked stream and the second hydrocracked stream may be stripped of gases in the cold stripping column 102 with a cold stripping media which is an inert gas such as steam from a cold stripping media line 106 to provide a cold stripper gaseous stream of naphtha, hydrogen, hydrogen sulfide, steam and other gases in a cold stripper overhead line 108 and a liquid cold stripped stream in a cold stripper bottoms line 110. The cold stripper gaseous stream in the cold stripper overhead line 108 may be condensed and separated in a receiver 112. A stripper net overhead line 114 from the receiver 112 carries a net stripper gaseous stream for further recovery of LPG and hydrogen in a light material recovery unit. Unstabilized liquid naphtha from the bottoms of the receiver 112 may be split between a reflux portion refluxed to the top of the cold stripping column 102 and a liquid stripper overhead stream which may be transported in a condensed stripper overhead line 116 to further recovery or processing. A sour water stream may be collected from a boot of the overhead receiver 112.

The cold stripping column 102 may be operated with a bottoms temperature between about 149° C. (300° F.) and about 288° C. (550° F.), preferably no more than about 260° C. (500° F.), and an overhead pressure of about 0.35 MPa (gauge) (50 psig), preferably no less than about 0.50 MPa (gauge) (72 psig), to no more than about 2.0 MPa (gauge) (290 psig). The temperature in the overhead receiver 112 ranges from about 38° C. (100° F.) to about 66° C. (150° F.) and the pressure is essentially the same as in the overhead of the cold stripping column 102.

The cold stripped stream in the cold stripper bottoms line 110 may comprise predominantly naphtha and kerosene boiling materials. The cold stripped stream in line 110 may be heated and fed to the product fractionation column 130. The product fractionation column 130 may be in downstream communication with the first hydrocracking reactor 40 and the second hydrocracking reactor 170, the cold stripper bottoms line 110 of the cold stripping column 102 and the stripping column 100. In an aspect, the fractionation column 130 may comprise more than one fractionation column. The product fractionation column 130 may be in downstream communication with one, some or all of the hot separator 50, the cold separator 56, the hot flash drum 80 and the cold flash drum 86.

The flash hot liquid stream comprising a hydrocracked stream in the hot flash bottoms line 84 may be fed to the hot stripping column 104 near a top thereof. The flash hot liquid stream may be stripped in the hot stripping column 104 of gases with a hot stripping media which is an inert gas such as steam from a line 120 to provide a hot stripper overhead stream of naphtha, hydrogen, hydrogen sulfide, steam and other gases in a hot stripper overhead line 118 and a liquid hot stripped stream in a hot stripper bottoms line 122. The hot stripper overhead line 118 may be condensed and a portion refluxed to the hot stripping column 104. However, in the embodiment of FIG. 1, the hot stripper overhead stream in the hot stripper overhead line 118 from the overhead of the hot stripping column 104 may be fed into the cold stripping column 102 directly in an aspect without first condensing or refluxing. The inlet for the cold flash bottoms line 90 carrying the flash cold liquid stream may be at a higher elevation than the inlet for the hot stripper overhead line 118. The hot stripping column 104 may be operated with a bottoms temperature between about 160° C. (320° F.) and about 360° C. (680° F.) and an overhead pressure of about 0.35 MPa (gauge) (50 psig), preferably no less than about 0.50 MPa (gauge) (72 psig), to about 2.0 MPa (gauge) (292 psig).

At least a portion of the hot stripped stream comprising a hydrocracked stream in the hot stripped bottoms line 122 may be heated and fed to the product fractionation column 130. The product fractionation column 130 may be in downstream communication with the hot stripped bottoms line 122 of the hot stripping column 104. The hot stripped stream in line 122 may be at a hotter temperature than the cold stripped stream in line 110.

In an aspect, the hot stripped stream in the hot stripped bottoms line 122 may be heated and fed to a prefractionation separator 124 for separation into a vaporized hot stripped stream in a prefractionation overhead line 126 and a liquid hot stripped stream in a prefractionation bottoms line 128. The vaporous hot stripped stream may be fed to the product fractionation column 130 in the prefractionation overhead line 128 The liquid hot stripped stream may be heated in a fractionation furnace and fed to the product fractionation column 130 in the prefractionation bottoms line 128 at an elevation below the elevation at which the prefractionation overhead line 126 feeds the vaporized hot stripped stream to the product fractionation column 130.

The product fractionation column 130 may be in downstream communication with the cold stripping column 102 and the hot stripping column 104 and may comprise more than one fractionation column for separating stripped hydrocracked streams into product streams. The product fractionation column 130 may fractionate hydrocracked streams, the cold stripped stream, the vaporous hot stripped stream and the liquid hot stripped stream, with an inert stripping media stream such as steam from line 132 to provide several product streams. The product streams from the product fractionation column 130 may include a net fractionated overhead stream comprising naphtha in a net overhead line 134, an optional heavy naphtha stream in line 136 from a side cut outlet, a kerosene stream carried in line 138 from a side cut outlet and a diesel stream in line 140 from a side cut outlet.

An UCO stream boiling above the diesel cut point may be taken in a fractionator bottoms line 142 from a bottom of the product fractionation column 130. A portion or all of the UCO stream in the fractionator bottoms line 142 may be purged from the process in purge line 144 if necessary. In an aspect, the UCO stream in line 144 comprises less than 3 wt % of the hydrocarbonaceous stream in line 18. Suitably, the UCO stream in line 144 comprises less than 2 wt % of the hydrocarbonaceous stream in line 18. Preferably, the UCO stream in line 144 comprises less than 1 wt % of the hydrocarbonaceous stream in line 18. The present process and apparatus 10 may make purge of the unconverted oil stream unnecessary such that all of the UCO stream in the fractionator bottoms line 142 is recycled as RO in the RO stream in a recycle line 146 to the second stage hydrocracking unit 150. A portion or all of the UCO stream in the fractionator bottoms line 142 may be recycled in the recycle line 146 as a RO stream to a second hydrocracking unit 150. More or all of the UCO stream in fractionator bottoms line 142 may be recycled to the second stage hydrocracking unit 150 because the second stage hydrocracking unit saturates aromatics including HPNA's and HPNA precursors to naphthenes, so that they can be hydrocracked in the second hydrocracking reactor 170.

Heat may be removed from the product fractionation column 130 by cooling at least a portion of the product streams and sending a portion of each cooled stream back to the fractionation column. These product streams may also be stripped to remove light materials to meet product purity requirements. A fractionated overhead stream in an overhead line 148 may be condensed and separated in a receiver 150 with a portion of the condensed liquid being refluxed back to the product fractionation column 130. The net fractionated overhead stream in line 134 may be further processed or recovered as naphtha product. The product fractionation column 130 may be operated with a bottoms temperature between about 260° C. (500° F.), and about 385° C. (725° F.), preferably at no more than about 350° C. (650° F.), and at an overhead pressure between about 7 kPa (gauge) (1 psig) and about 69 kPa (gauge) (10 psig). A portion of the UCO stream in the atmospheric bottoms line 142 may be reboiled and returned to the product fractionation column 130 instead of adding an inert stripping media stream such as steam in line 132 to heat to the atmospheric fractionation column 130.

The RO stream in RO line 146 may be recycled to a second hydrocracking unit 150. In hydrocracking, we have found that HPNA formation is due to condensation of aromatic precursors present in the hydrocarbon feed stream or the RO stream. We propose to completely saturate aromatics to naphthenes to prevent formation of HPNA's from aromatics and HPNA precursors. Aromatic saturation typically requires a noble metal catalyst. In the second hydrocracking unit 150, most of the sulfur and nitrogen has already been removed as hydrogen sulfide and ammonia from the recycle gas from the cold gaseous stream from cold overhead line 58 in the amine scrubbing column 62 and in the from the stripper off gas in the stripper net overhead line 114. Hence, these contaminants will not poison a noble metal catalyst in a second hydrotreating reactor 160.

The second hydrocracking unit 150 comprises a second hydrotreating reactor 160 and a second hydrocracking reactor 170. The RO stream may be mixed with a second hydrotreating hydrogen stream in a second hydrotreating hydrogen line 152 to provide a hydrotreating RO stream in a second hydrotreating feed line 154. The hydrotreating RO stream is heated and fed to the second hydrotreating reactor 160. The hydrotreating RO stream in the second hydrocarbon feed line 154 is hydrotreated over the second hydrotreating catalyst in the second hydrotreating reactor 160 to provide a second hydrotreated RO stream that exits the second hydrotreating reactor 160 in a second hydrotreating effluent line 162 which can be taken as a second hydrocracking feed stream. Supplemental hydrogen in a second hydrotreating supplemental hydrogen line 161 may be added at an interstage location between catalyst beds in the second hydrotreating reactor 160.

The second hydrotreating reactor 160 is in downstream communication with the product fractionation column 130. Particularly, the second hydrotreating reactor 160 is in downstream communication with a bottoms line 142 of the product fractionation column 130.

The hydrotreating that is performed in the second hydrotreating reactor is geared predominantly toward aromatics saturation. The second hydrotreating catalyst in the second hydrotreating reactor 160 is preferably different from the first hydrotreating catalyst in the first hydrotreating reactor 30. Suitable second hydrotreating catalysts for use in the second hydrotreating reactor are saturation hydrotreating catalysts and include those which are comprised of at least one Group VIII metal, preferably a noble metal comprising rhenium, ruthenium, rhodium, palladium, silver, osmium, iridium, platinum, and/or gold and optionally at least one non-noble metal, preferably cobalt, nickel, vanadium, molybdenum and/or tungsten, on a high surface area support material, preferably alumina. Other suitable hydrotreating catalysts include zeolitic catalysts and/or un-supported hydrotreating catalysts. More than one type of second hydrotreating catalyst may be used in the second hydrotreating reactor 160. The noble metal is typically present in an amount ranging from about 0.001 to about 20 wt %, preferably from about 0.05 to about 2 wt %. The non-noble metal will typically be present in an amount ranging from about 0.05 to about 30 wt %, preferably from about 1 to about 20 wt %. At least 60 wt % of the aromatics, preferably at least 90% of the aromatics, in the RO stream entering the second hydrotreating reactor 160 in the second hydrocarbon feed line 154 are saturated in the second hydrotreating reactor 160.

Preferred reaction conditions in the second hydrotreating reactor 160 include a temperature from about 290° C. (550° F.) to about 455° C. (850° F.), suitably 316° C. (600° F.) to about 427° C. (800° F.) and preferably 343° C. (650° F.) to about 399° C. (750° F.), a pressure from about 2.1 MPa (gauge) (300 psig), preferably 4.1 MPa (gauge) (600 psig) to about 20.6 MPa (gauge) (3000 psig), suitably 13.8 MPa (gauge) (2000 psig), preferably 12.4 MPa (gauge) (1800 psig), a liquid hourly space velocity of the fresh hydrocarbonaceous feedstock from about 0.1 $hr^{-1}$, suitably 0.5 $hr^{-1}$, to about 10 $hr^{-1}$, preferably from about 1.5 to about 8.5 $hr^{-1}$, and a hydrogen rate of about 168 $Nm^3/m^3$ (1,000 scf/bbl), to about 1,011 $Nm^3/m^3$ oil (6,000 scf/bbl), preferably about 168 $Nm^3/m^3$ oil (1,000 scf/bbl) to about 674 $Nm^3/m^3$ oil (4,000 scf/bbl), with a hydrotreating catalyst or a combination of hydrotreating catalysts.

Gas may be separated from the second hydrocracking feed stream in the second hydrotreating effluent line 162 to remove hydrogen gas laden with small amounts of ammonia and hydrogen sulfide from the second hydrocracking feed stream in a separator, but the second hydrocracking feed stream is suitably fed directly to the second hydrocracking reactor 170 without separation. The second hydrocracking feed stream may be mixed with a second hydrocracking hydrogen stream in a second hydrocracking hydrogen line 164 from the second stage hydrogen line 166 and is fed through a first inlet **162*i* to the first hydrocracking reactor 170 to be hydrocracked. The second hydrocracking reactor 170** may be in downstream communication with the second hydrotreating reactor.

The second hydrocracking reactor 170 may be a fixed bed reactor that comprises one or more vessels, single or multiple catalyst beds 172 in each vessel, and various combinations of hydrotreating catalyst, hydroisomerization catalyst and/or hydrocracking catalyst in one or more vessels. It is contemplated that the second hydrocracking reactor 170 be operated in a continuous liquid phase in which the volume of the liquid hydrocarbon feed is greater than the volume of the hydrogen gas. The second hydrocracking reactor 170 may also be operated in a conventional continuous gas phase, a moving bed or a fluidized bed hydroprocessing reactor.

The second hydrocracking reactor 170 comprises a plurality of catalyst beds 172. If the second hydrocracking unit 150 does not include a second hydrotreating reactor 160, the first catalyst bed in the hydrocracking reactor 170 may include a second hydrotreating catalyst for the purpose of saturating aromatic rings in the RO stream before it is hydrocracked with the second hydrocracking catalyst in subsequent vessels or catalyst beds 172 in the second hydrocracking reactor 170.

The hydrotreated second hydrocracking feed stream is hydrocracked over the second hydrocracking catalyst in the second hydrocracking catalyst beds 172 in the presence of a second hydrocracking hydrogen stream from a second hydrocracking hydrogen line 164 to provide a second hydrocracked stream. Subsequent catalyst beds 172 in the hydrocracking reactor may comprise hydrocracking catalyst over which additional hydrocracking occurs. Hydrogen manifold 176 may deliver supplemental hydrogen streams to one, some or each of the catalyst beds 172. In an aspect, the supplemental hydrogen is added to each of the downstream catalyst beds 172 at an interstage location between adjacent beds, so supplemental hydrogen is mixed with hydrocracked effluent exiting from the upstream catalyst bed 172 before entering the downstream catalyst bed 172.

The second hydrocracking reactor 170 may provide a total conversion of at least about 1 vol % and typically greater than about 40 vol % of the second hydrocracking feed stream in the second hydrotreating effluent line 162 to products boiling below the diesel cut point. The second hydrocracking reactor 170 may complete the conversion partially achieved in the first hydrocracking reactor 40. The second hydrocracking reactor 170 may operate at partial conversion of more than about 30 vol % or full conversion of at least about 90 vol % of the first hydrocracking feed stream in the first hydrocracking feed line 32 based on total conversion. The second hydrocracking reactor 170 may be operated at mild hydrocracking conditions which will provide about 1 to about 60 vol %, preferably about 20 to about 50 vol %, total conversion of the hydrocarbon feed stream to product boiling below the diesel cut point.

The second hydrocracking catalyst may be the same as or different than the first hydrocracking catalyst or may have some of the same as and some different than the first hydrocracking catalyst in the first hydrocracking reactor 40. The second hydrocracking catalyst may utilize amorphous silica-alumina bases or low-level zeolite bases combined with one or more Group VIII or Group VIB metal hydrogenating components. Additional hydrogenating components may be selected from Group VIB for incorporation with the zeolite base.

By one approach, the hydrocracking conditions in the second hydrocracking reactor 170 may be the same as or different than in the first hydrocracking reactor 40. Conditions in the second hydrocracking reactor may include a temperature from about 290° C. (550° F.) to about 468° C. (875° F.), preferably 343° C. (650° F.) to about 445° C. (833° F.), a pressure from about 4.8 MPa (gauge) (700 psig) to about 20.7 MPa (gauge) (3000 psig), a liquid hourly space velocity (LHSV) from about 0.4 to less than about 2.5 $hr^{-1}$ and a hydrogen rate of about 421 $Nm^3/m^3$ (2,500 scf/bbl) to about 2,527 $Nm^3/m^3$ oil (15,000 scf/bbl).

The second hydrocracked stream may exit the second hydrocracking reactor 170 in the second hydrocracked effluent line 46, be heat exchanged with the hydrotreating RO stream in the second hydrotreating feed line 154 and combined with the first hydrocracked effluent stream in first hydrocracked effluent line 48. The first hydrocracked effluent stream and the second hydrocracked effluent stream combined in combined hydrocracked effluent line 49 are separated and fractionated in the fractionation section 14 in downstream communication with the second hydrocracking reactor 170 as previously described.

Figure 2:
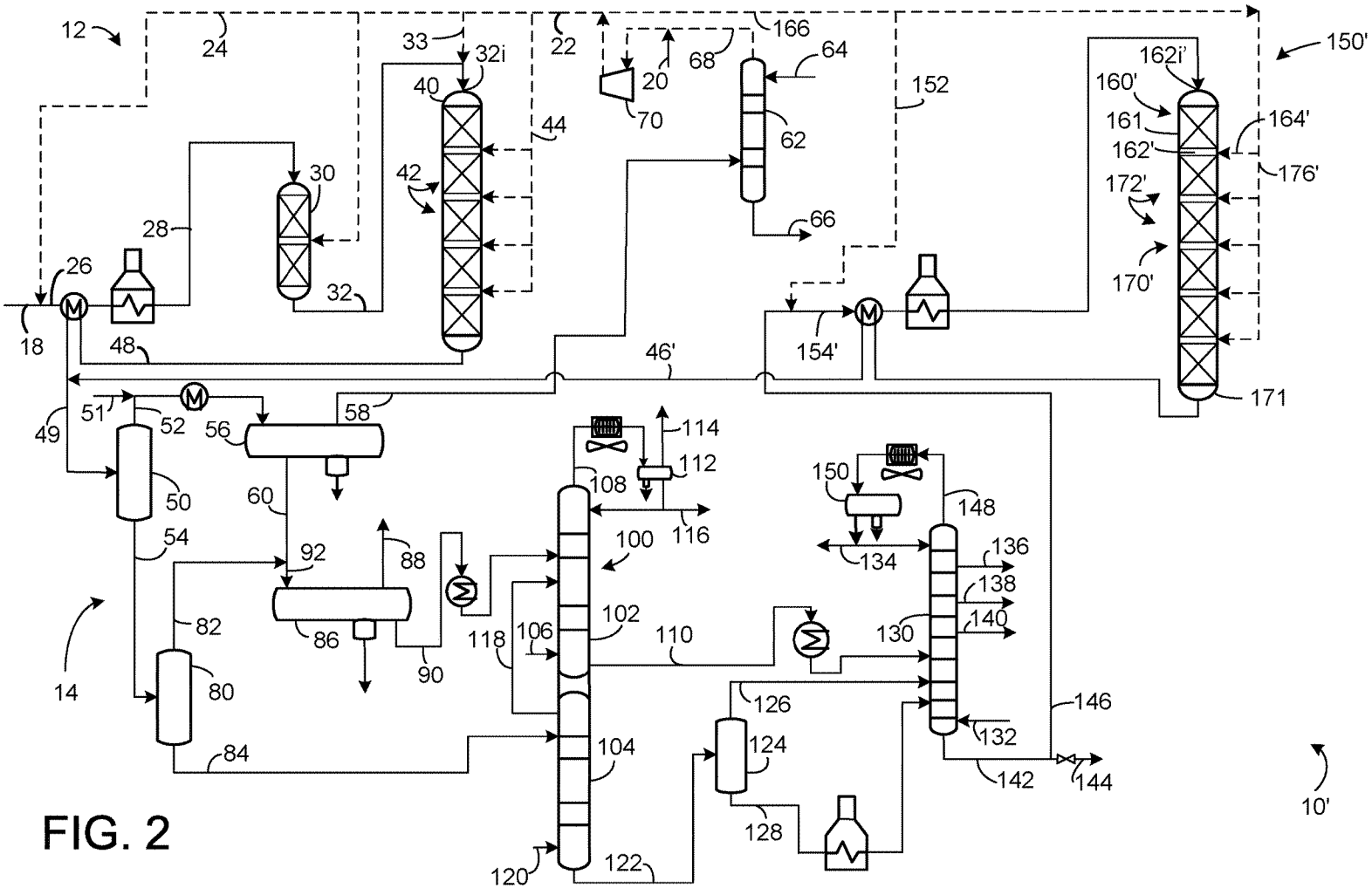
FIG. 2 is a schematic drawing of an alternative two-stage hydrocracking unit.

FIG. 2 shows an embodiment of the apparatus and process 10' that locates the second hydrotreating reactor 160' and the second hydrocracking reactor 170' in the same reactor vessel 171 in a second hydrocracking unit 150'. Elements in FIG. 2 with the same configuration as in FIG. 1 will have the same reference numeral as in FIG. 1. Elements in FIG. 2 which have a different configuration as the corresponding element in FIG. 1 will have the same reference numeral but designated with a prime symbol (').The configuration and operation of the embodiment of FIG. 2 is essentially the same as in FIG. 1 with the following exceptions.

The RO stream in RO line 146 may be recycled to the second hydrocracking unit 150'. The second hydrocracking unit 150' comprises the second hydrotreating reactor 160' located in the second hydrocracking reactor 170'. The RO stream in the RO line 146 may be mixed with a second hydrotreating hydrogen stream in a second hydrotreating hydrogen line 152 to provide a hydrotreating RO stream in a second hydrotreating feed line 154'. The hydrotreating RO stream is heated and fed to the second hydrocracking reactor 170' through an inlet **162*i*'. In the embodiment of FIG. 2, the second hydrotreating reactor 160' comprises a first catalyst bed 161 in the second hydrocracking reactor 170'. The first catalyst bed is a bed of hydrotreating catalyst suited for saturating aromatics as described for FIG. 1. The hydrotreating RO stream in the second hydrocarbon feed line 154' is hydrotreated over the second hydrotreating catalyst in the first catalyst bed 161 in the second hydrotreating reactor 160' to provide a second hydrotreated RO stream that exits the second hydrotreating reactor 160' in a second hydrotreating effluent interbed location 162'** which can be taken as a second hydrocracking feed stream.

The hydrotreated second hydrocracking feed stream from the first catalyst bed 161 may be optionally hydrotreated over additional hydrotreating catalyst beds but then is hydrocracked over a second hydrocracking catalyst in second hydrocracking catalyst beds 172' in the presence of a second hydrocracking hydrogen stream from a second hydrocracking hydrogen line 164' to provide a second hydrocracked stream. The second hydrocracking hydrogen line 164' adds hydrogen to the hydrotreated second hydrocracking feed stream at the interbed location 162'. Subsequent catalyst beds 172' in the hydrocracking reactor 170' may comprise hydrocracking catalyst over which additional hydrocracking occurs. Hydrogen manifold 176' may deliver supplemental hydrogen streams to one, some or each of the catalyst beds 172'. In an aspect, the supplemental hydrogen is added to each of the downstream catalyst beds 172' at an interstage location between adjacent beds, so supplemental hydrogen is mixed with hydrocracked effluent exiting from the upstream catalyst bed 172' before entering the downstream catalyst bed 172'. Accordingly, the RO stream from RO line 146 is hydrotreated and the second hydrocracking feed stream from the interbed location 162' is hydrocracked in the same reactor vessel 171.

The second hydrocracked stream may exit the second hydrocracking reactor 170' in the second hydrocracked effluent line 46', be heat exchanged with the hydrotreating RO stream in the second hydrotreating feed line 154' and be combined with the first hydrocracked effluent stream in first hydrocracked effluent line 48. The first hydrocracked effluent stream and the second hydrocracked effluent stream in a combined hydrocracked effluent stream in a combined line 49 may be separated and fractionated in the fractionation section 14 in downstream communication with the second hydrocracking reactor 170' as previously described.

By saturating aromatic HPNA's and HPNA precursors, the present process and apparatus can achieve total conversion of hydrocarbonaceous feed in hydrocarbonaceous feed line 18 to product boiling at or below the diesel cut point. The product is free or has only minimal quantity of HPNA's allowing a longer cycle length for the process and apparatus because the equipment is not fouled and the catalyst deactivates more slowly while eliminating the need to manage HPNA's. The distillate product has a lower aromatics content, thereby boosting its cetane number and providing a higher volume yield with lower concentrations of sulfur and nitrogen.

SPECIFIC EMBODIMENTS

While the following is described in conjunction with specific embodiments, it will be understood that this description is intended to illustrate and not limit the scope of the preceding description and the appended claims.

A first embodiment of the invention is a process for hydrocracking a hydrocarbon stream comprising hydrocracking a first hydrocracking feed stream over a first hydrocracking catalyst and hydrogen to provide a hydrocracked stream; fractionating the hydrocracked stream in a fractionation section to provide a recycle oil stream; hydrotreating the recycle oil stream over a hydrotreating catalyst and hydrogen to provide a second hydrocracking feed stream; and hydrocracking the second hydrocracking feed stream over a second hydrocracking catalyst and hydrogen. An embodiment of the invention is one, any or all of prior embodiments in this paragraph up through the first embodiment in this paragraph wherein the hydrotreating the recycle oil stream comprises hydrotreating the recycle oil stream over a noble metal catalyst. An embodiment of the invention is one, any or all of prior embodiments in this paragraph up through the first embodiment in this paragraph wherein the hydrotreating the recycle oil stream comprises hydrotreating the recycle oil stream to saturate at least 60 wt % of aromatics in the recycle oil stream. An embodiment of the invention is one, any or all of prior embodiments in this paragraph up through the first embodiment in this paragraph further comprising hydrotreating a first hydrocarbon feed stream to provide the first hydrocracking feed stream prior to hydrocracking the first hydrocracking feed stream. An embodiment of the invention is one, any or all of prior embodiments in this paragraph up through the first embodiment in this paragraph wherein a hydrotreating catalyst in the first hydrotreating step is different than a hydrotreating catalyst in the second hydrotreating step. An embodiment of the invention is one, any or all of prior embodiments in this paragraph up through the first embodiment in this paragraph wherein the hydrotreating the recycle oil stream and hydrocracking the second hydrocracking feed stream are conducted in the same reactor vessel. An embodiment of the invention is one, any or all of prior embodiments in this paragraph up through the first embodiment in this paragraph wherein the fractionating step comprises separating the hydrocracked stream into a liquid stream and stripping gases from the liquid stream to provide a stripped stream. An embodiment of the invention is one, any or all of prior embodiments in this paragraph up through the first embodiment in this paragraph further comprising fractionating the stripped stream to provide a naphtha stream, a distillate stream and an unconverted oil stream from which the recycle oil stream is taken. An embodiment of the invention is one, any or all of prior embodiments in this paragraph up through the first embodiment in this paragraph wherein the recycle oil stream is taken from a bottom of a fractionation column.

A second embodiment of the invention is a process for hydrocracking a hydrocarbon stream comprising hydrotreating a first hydrocarbon stream to provide a first hydrocracking feed stream; hydrocracking a first hydrocracking feed stream over a first hydrocracking catalyst and hydrogen to provide a hydrocracked stream; fractionating the hydrocracked stream in a fractionation section to provide a recycle oil stream; hydrotreating the recycle oil stream over a hydrotreating catalyst and hydrogen to provide a second hydrocracking feed stream; and hydrocracking the second hydrocracking feed stream over a second hydrocracking catalyst and hydrogen. An embodiment of the invention is one, any or all of prior embodiments in this paragraph up through the second embodiment in this paragraph wherein the hydrotreating the recycle oil stream comprises hydrotreating the recycle oil stream over a noble metal catalyst to saturate at least 60 wt % of all aromatics. An embodiment of the invention is one, any or all of prior embodiments in this paragraph up through the second embodiment in this paragraph wherein a hydrotreating catalyst in the first hydrotreating step is different than a hydrotreating catalyst in the second hydrotreating step. An embodiment of the invention is one, any or all of prior embodiments in this paragraph up through the second embodiment in this paragraph wherein the hydrotreating the recycle oil stream and hydrocracking the second hydrocracking feed stream steps are conducted in the same reactor vessel. An embodiment of the invention is one, any or all of prior embodiments in this paragraph up through the second embodiment in this paragraph wherein the fractionating step comprises separating the hydrocracked stream into a liquid stream and stripping gases from the liquid stream to provide a stripped stream. An embodiment of the invention is one, any or all of prior embodiments in this paragraph up through the second embodiment in this paragraph further comprising fractionating the stripped stream to provide a naphtha stream, a distillate stream and an unconverted oil stream from which the recycle oil stream is taken. An embodiment of the invention is one, any or all of prior embodiments in this paragraph up through the second embodiment in this paragraph wherein the recycle oil stream is taken from a bottom of a fractionation column.

A third embodiment of the invention is an apparatus for hydrocracking a hydrocarbon stream comprising a first hydrocracking reactor for hydrocracking a first hydrocracking feed stream; a fractionation column in downstream communication with the first hydrocracking reactor; a hydrotreating reactor in downstream communication with the fractionation column; and a second hydrocracking reactor in downstream communication with the hydrotreating reactor. An embodiment of the invention is one, any or all of prior embodiments in this paragraph up through the third embodiment in this paragraph wherein the hydrotreating reactor and the second hydrocracking reactor are in the same vessel. An embodiment of the invention is one, any or all of prior embodiments in this paragraph up through the third embodiment in this paragraph wherein the fractionation section comprises a separation section, a stripper column and a fractionation column. An embodiment of the invention is one, any or all of prior embodiments in this paragraph up through the third embodiment in this paragraph wherein the hydrotreating reactor is in downstream communication with a bottoms line of the fractionation column.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for hydrocracking a hydrocarbon stream comprising:

hydrocracking a first hydrocracking feed stream over a first hydrocracking catalyst and hydrogen in a first hydrocracking reactor to provide a first hydrocracked stream;

fractionating said first hydrocracked stream in a fractionation section to provide a recycle oil stream;

hydrotreating said recycle oil stream over a hydrotreating catalyst and hydrogen in a second hydrocracking reactor to saturate at least 60 wt % of aromatics in said recycle oil stream and provide a second hydrocracking feed stream, wherein said first hydrocracking reactor and said second hydrocracking reactor are different; and hydrocracking said second hydrocracking feed stream over a second hydrocracking catalyst and hydrogen.

2. The process of claim 1 wherein said hydrotreating said recycle oil stream comprises hydrotreating said recycle oil stream over a noble metal catalyst.

3. The process of claim 1 further comprising hydrotreating a first hydrocarbon feed stream to provide said first hydrocracking feed stream prior to hydrocracking said first hydrocracking feed stream.

4. The process of claim 3 wherein a hydrotreating catalyst in said first hydrotreating step is different than a hydrotreating catalyst in said second hydrotreating step.

5. The process of claim 1 wherein said fractionating step comprises separating said hydrocracked stream into a liquid stream and stripping gases from said liquid stream to provide a stripped stream.

6. The process of claim 5 further comprising fractionating said stripped stream to provide a naphtha stream, a distillate stream and an unconverted oil stream from which said recycle oil stream is taken.

7. The process of claim 3 wherein said recycle oil stream is taken from a bottom of a fractionation column.

8. A process for hydrocracking a hydrocarbon stream comprising:

hydrotreating a first hydrocarbon stream to provide a first hydrocracking feed stream;

hydrocracking a first hydrocracking feed stream over a first hydrocracking catalyst and hydrogen in a first hydrocracking reactor to provide a first hydrocracked stream;

separating said first hydrocracked stream into a liquid stream;

stripping gases from said liquid stream to provide a stripped stream;

fractionating said stripped stream in a fractionation section to provide a naphtha stream, a distillate stream and an unconverted oil stream from which a recycle oil stream is taken;

hydrotreating said recycle oil stream over a hydrotreating catalyst and hydrogen in a second hydrocracking reactor to provide a second hydrocracking feed stream, wherein said first hydrocracking reactor and said second hydrocracking reactor are different; and hydrocracking said second hydrocracking feed stream over a second hydrocracking catalyst and hydrogen.

9. The process of claim 8 wherein said hydrotreating said recycle oil stream comprises hydrotreating said recycle oil stream over a noble metal catalyst to saturate at least 60 wt % of all aromatics.

10. The process of claim 8 wherein a hydrotreating catalyst in said first hydrotreating step is different than a hydrotreating catalyst in said second hydrotreating step.

11. The process of claim 8 wherein said recycle oil stream is taken from a bottom of a fractionation column.

* * * * *